US006517320B1

(12) United States Patent
Reynolds

(10) Patent No.: US 6,517,320 B1
(45) Date of Patent: Feb. 11, 2003

(54) HOSE SIPHON

(76) Inventor: Joel M. Reynolds, P.O. Box 581, Oak Grove, LA (US) 71263

( * ) Notice: Subject to any disclaimer, the term of this patent is extended or adjusted under 35 U.S.C. 154(b) by 30 days.

(21) Appl. No.: 09/922,583

(22) Filed: Aug. 6, 2001

(51) Int. Cl.[7] ..... A61M 1/00
(52) U.S. Cl. ..... 417/152; 210/169
(58) Field of Search ..... 417/152, 131; 210/780, 169; 239/304, 532, 318, 10; 119/5, 259

(56) References Cited

U.S. PATENT DOCUMENTS

| | | | | |
|---|---|---|---|---|
| 905,818 A | | 12/1908 | Langford | |
| 1,037,368 A | | 9/1912 | Symons | |
| 1,527,135 A | | 2/1925 | Hepburn et al. | |
| 1,630,543 A | | 5/1927 | Scott | |
| 1,826,829 A | | 10/1931 | Scott | |
| 4,527,740 A | * | 7/1985 | Gunzel et al. | 239/318 |
| 4,610,784 A | * | 9/1986 | Reyniers | 210/169 |
| 4,722,670 A | | 2/1988 | Zweifel | 417/181 |
| 4,943,211 A | * | 7/1990 | Boegh | 417/131 |
| 5,133,503 A | * | 7/1992 | Giordano et al. | 239/532 |
| 5,199,378 A | * | 4/1993 | Kissick, Jr. et al. | 119/5 |
| 5,259,557 A | * | 11/1993 | Spriggs et al. | 239/304 |
| 5,695,654 A | * | 12/1997 | Schultz | 210/780 |
| 6,058,884 A | * | 5/2000 | Rawls | 119/259 |
| 6,238,385 B1 | * | 9/2001 | Beaver et al. | 239/10 |

FOREIGN PATENT DOCUMENTS

| | | | |
|---|---|---|---|
| GB | 2287726 | * 9/1995 | F04F/10/00 |
| JP | 363249000 | * 10/1988 | F04F/10/00 |

* cited by examiner

*Primary Examiner*—Teresa Walberg
*Assistant Examiner*—Leonid M Fastovsky
(74) *Attorney, Agent, or Firm*—John M Harrison

(57) ABSTRACT

A hose siphon for cleaning sand, dirt and other particulate impurities from tanks or vessels. The hose siphon typically includes an aspirator conduit for receiving the pressurized water and a main conduit for receiving the pressurized water from the aspirator conduit. The main conduit includes a suction end for fluid communication with the tank or vessel and a discharge end for discharging the pressurized water from the main conduit. As the pressurized water flows through the aspirator conduit and into the main conduit, sand filtering medium and trapped impurities are aspirated from the vessel into the suction end of the main conduit, and discharged from the discharge end of the main conduit with the pressurized water. A water discharge hose is provided in fluid communication with the aspirator conduit for distributing a portion of the pressurized water to the tank or vessel and maintaining a suspension or slurry of the sand medium and particulate impurities in the tank or vessel.

14 Claims, 2 Drawing Sheets

HOSE SIPHON

BACKGROUND OF THE INVENTION

FIELD OF THE INVENTION

This invention relates to suction cleaners for tanks and the like and more particularly, to a hose siphon for cleaning sand, dirt and other particulate impurities from tanks or other containers such as water filters for swimming pools. The hose siphon typically includes an aspirator conduit for receiving the pressurized water and a main conduit for receiving the pressurized water from the aspirator conduit. The main conduit includes a suction end for fluid communication with the tank or filter and a discharge end for discharging the pressurized water from the main conduit. As the pressurized water flows through the aspirator conduit and into the main conduit, sand filtering medium and particulate impurities trapped in the medium are aspirated from the tank or filter into the suction end of the main conduit and discharged from the discharge end of the main conduit with the pressurized water. A water discharge hose is provided in fluid communication with the aspirator conduit for distributing a portion of the pressurized water to the tank or filter and maintaining a suspension or slurry of the sand medium and the particulate impurities in the tank or filter.

Swimming pools are frequently cleaned of dirt, sand and other particulate debris by continuous operation of a water filter located adjacent to the pool. These water filters typically include a sand medium, an intake pipe for drawing the water from the pool into the filter and a discharge pipe for distributing the filtered water from the filter back into the pool. Periodically, the sand medium and the filter become filled with the dirt and other particulate impurities filtered through the sand from the water, and these impurities must be removed with the sand medium and the filter re-packed with fresh medium for optimum and continued operation of the filter.

Suction devices of various design which utilize the Venturi effect to remove impurities from a vessel, are known in the art. Patents in this regard include U.S. Pat. Nos. 905,818; 1,037,368; 1,527,135; 1,630,543; 1,826,829; and 4,722,670.

An object of the present invention is to provide a hose siphon which is capable of removing sand, dirt and other impurities from a vessel.

Another object of this invention is to provide a hose siphon which is capable of removing impurities from a vessel while maintaining a slurry of the impurities in the vessel during removal Still another object of this invention is to provide a hose siphon which can be used for removing impurities from a vessel, which hose siphon typically includes an aspirator conduit for receiving pressurized water; a main conduit for receiving the pressurized water from the aspirator conduit, which main conduit has a suction end for fluid communication with the vessel and a discharge end for discharging the pressurized water from the main conduit, such that the impurities are aspirated from the vessel into the suction end of the main conduit and discharged from the discharge end of the main conduit with the pressurized water, responsive to flow of the pressurized water through the aspirator conduit and into the main conduit; and a water discharge hose provided in fluid communication with the aspirator conduit for distributing a portion of the pressurized water to the vessel in order to maintain a suspension or slurry of the particulate impurities in the vessel.

SUMMARY OF THE INVENTION

These and other objects of the invention are provided in a hose siphon which is suitable for cleaning sand, dirt and other particulate impurities from vessels and is particularly suitable for cleaning sand from swimming pool filters having a sand medium. The hose siphon typically includes an aspirator conduit for receiving a stream of pressurized water from a faucet or other source and a main conduit for receiving the pressurized water from the aspirator conduit. The main conduit includes a suction end for fluid communication with the vessel and a discharge end for discharging the pressurize water from the main conduit. As the pressurized water flows through the aspirator conduit and into the main conduit, the sand medium and impregnated impurities are aspirated from the vessel into the suction end of the main conduit, and discharged from the discharge end of the main conduit with the pressurized water. A water discharge hose is provided in fluid communication with the aspirator conduit for distributing a portion of the pressurized water to the vessel and maintaining a suspension or slurry of the sand medium and particulate impurities in the vessel for easy removal therefrom.

BRIEF DESCRIPTION OF THE DRAWINGS

The invention will be better understood by reference to the accompanying drawings, wherein.

DESCRIPTION OF THE PREFERRED EMBODIMENTS

Figure 1:
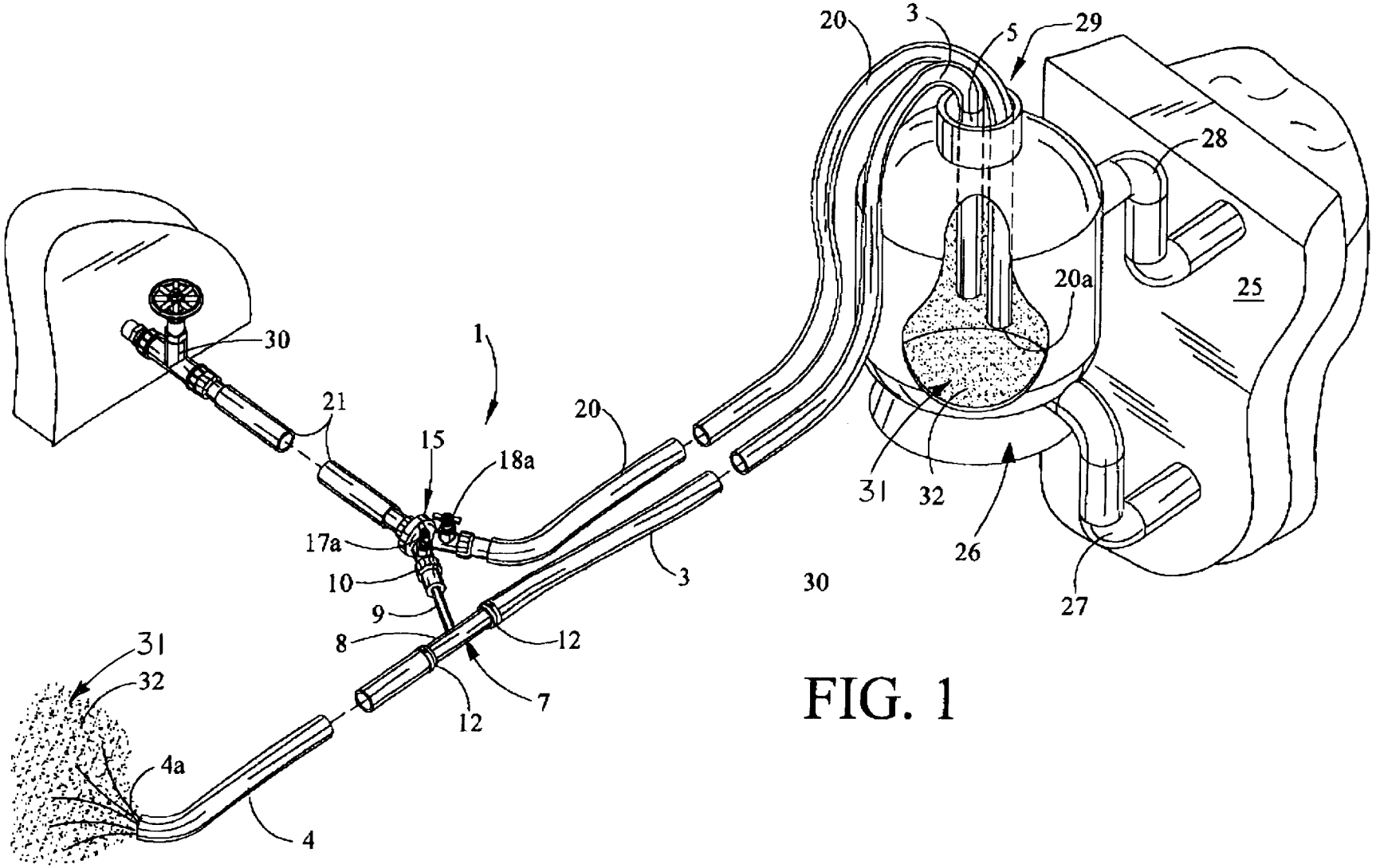
FIG. 1 is a perspective view of an illustrative embodiment of the hose siphon of this invention, in typical application of the hose siphon.
Figure 2:
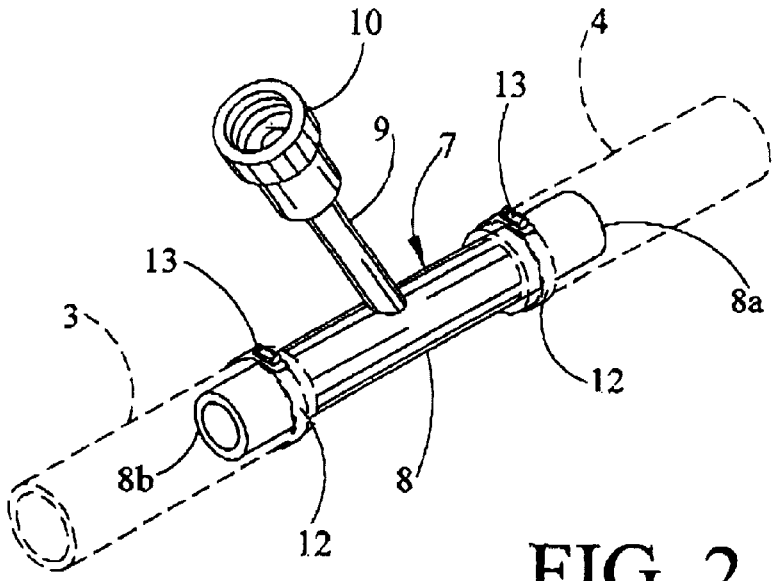
FIG. 2 is a perspective view, partially in section, of the main conduit and aspirator conduit components of the hose siphon.
Figure 3:
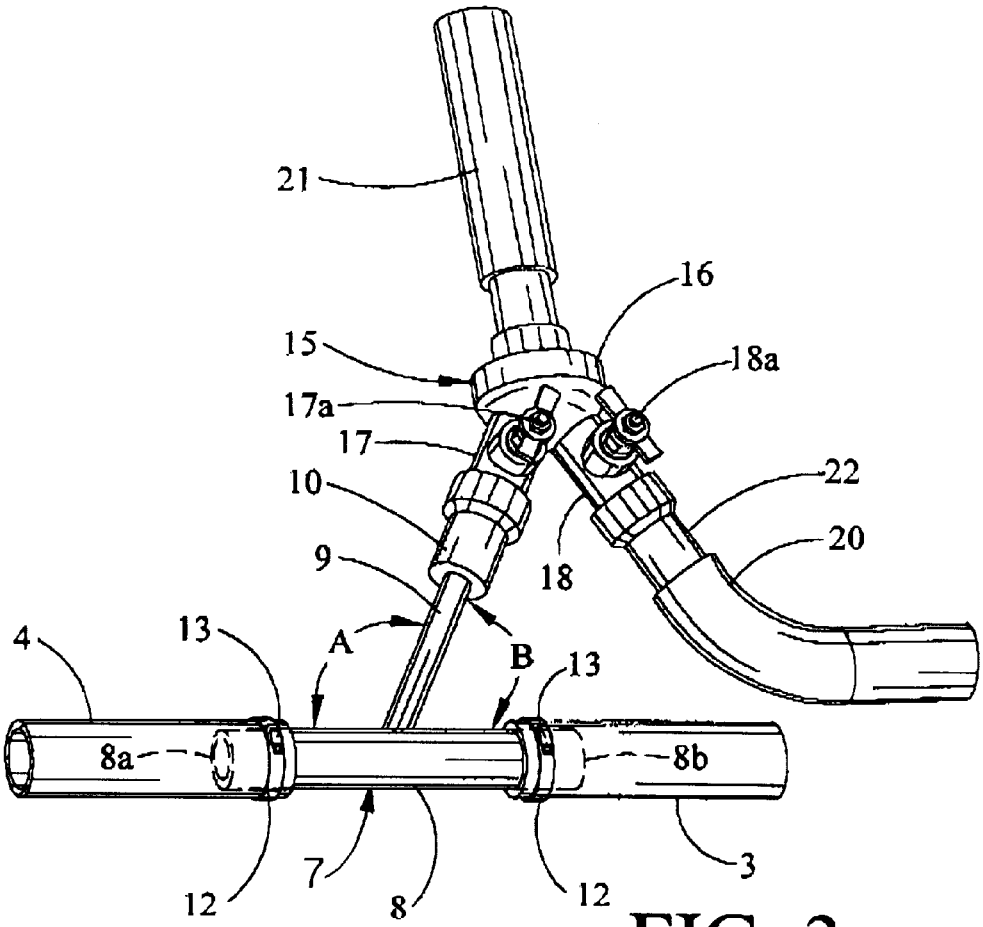
FIG. 3 is a perspective view, partially in section, of the hose siphon, with a hose adaptor shown attached to the aspirator conduit component in typical application of the hose siphon.

Referring to the drawings, an illustrative embodiment of the hose siphon of this invention is generally illustrated by reference numeral 1 in FIG. 1. The hose siphon 1 typically includes a siphon fitting 7, including an elongated, tubular main conduit 8 having a discharge end 8*a* and a suction end 8*b,* as illustrated in FIGS. 2 and 3. An aspirator conduit 9 extends from fluid communication with the main conduit 8, between the discharge end 8*a* and the suction end 8*b* thereof. As illustrated in FIG. 3, the longitudinal axis of the aspirator conduit 9 is disposed at an obtuse angle "A" and at an acute angle "B" with respect to the longitudinal axis of the main conduit 8. Typically, the obtuse angle "A" is about 160 degrees, whereas the acute angle "B" is about 20 degrees. However, it is understood that the angle "A" can be any obtuse angle and the angle "B" can be any acute angle, as desired. An elongated discharge hose 4, having a discharge end 4*a,* as illustrated in FIG. 1, has an opposite end which is attached in fluid communication to the discharge end 8*a* of the main conduit 8, and an elongated suction hose 3 is attached in fluid communication to the suction end 8*b* of the main conduit 8, typically by means of respective hose clamps 12 which are secured by means of screws 13. As further illustrated in FIG. 3, a conventional, three-way hose adaptor 15 is connected in fluid communication to the aspirator conduit 9 by means of an aspirator conduit male coupling 17 of the hose adaptor 15, which aspirator conduit male coupling 17 threadibly engages a companion female hose coupling 10 of the aspirator conduit 9. In like manner, a water discharge hose 20, the purpose of which will be hereinafter described, is connected in fluid communication to a threaded water discharge male coupling 18 of the hose adaptor 15 by means of a companion female hose coupling 22 of the water discharge hose 20. The aspirator conduit male coupling 17 and the water discharge male coupling 18 of the hose adaptor 15 are typically fitted with valves 17*a* and 18*a,* respectively, for regulating the flow of water through the aspirator conduit male coupling 17 and the water discharge male coupling 18, respectively. A female hose coupling 16 of the hose adaptor 15 receives the companion threaded male hose coupling (not illustrated) of a water hose 21, such as a conventional garden hose, the opposite, female hose coupling (not illustrated) end of which water hose 21 is typically connected to an outdoor water faucet 30, for example, as illustrated in FIG. 1. An elongated suction wand 5 can typically be threadibly attached to the end of the suction hose 3 to facilitate enhanced hand control of the suction end of the suction hose 3 during operation of the hose siphon 1, as further shown in FIG. 1 and hereinafter described.

Referring again to FIGS. 1 and 3 of the drawings, in typical operation the hose siphon 1 is capable of removing an aqueous slurry containing a suspension of sand medium 31, dirt and other particulate impurities 32 from a swimming pool water filter 26, which may be conventional. Briefly, the swimming pool water filter 26 is connected to a swimming pool 25 by means of a water intake pipe 27, which distributes water from the swimming pool 25 to the water filter 26 and through a sand medium 31 contained in the water filter 26, and finally, a water discharge pipe 28, which distributes the filtered water from the water filter 26 back into the swimming pool 25. During continuous operation, the sand medium 31 in the water filter 26 removes the dirt and other particulate impurities 32 from the water entering the water filter 26 from the swimming pool 25 through the water intake pipe 27, and distributes the filtered water back into the swimming pool 25 through the water discharge pipe 28. Over time, the sand medium 31 in the water filter 26 becomes filled with the dirt and other impurities 32 removed from the swimming pool 25, and these impurities 32, along with the sand medium 31, must be removed from the water filter 26 for repacking with fresh sand medium 31 and effecting continued and optimum operation of the water filter 26.

The hose siphon 1 is initially assembled by threading the female hose coupling (not illustrated) on one end of the water hose 21, on the companion male faucet coupling (not illustrated) of the water faucet 30. As illustrated in FIG. 3, the male hose coupling (not illustrated) on the opposite end of the water hose 21 is threaded in the companion female hose coupling 16 of the hose adaptor 15. The aspirator conduit male coupling 17 of the hose adaptor 15 is threadibly connected to the female hose coupling 10 of the aspirator conduit 9, and the water discharge male coupling 18 of the hose adaptor 15 is in like manner connected to the female hose coupling 22 of the water discharge hose 20. Finally, the suction wand 5 (FIG. 1) may be attached to the suction hose 3, the water discharge end 20*a* of the water discharge hose 20 is placed in the interior of the water filter 26, and the discharge end 4*a* of the discharge hose 4 is placed on the ground, as illustrated, or in a suitable collection receptacle (not illustrated).

Upon initiating flow of water from the water faucet 30 and through the water hose 21, the pressurized water enters the female hose coupling 16 of the hose adaptor 15, where the water stream is diverted into two streams of pressurized water, one of which flows through the aspirator conduit male coupling 17 and the other, simultaneously through the water discharge male coupling 18, of the hose adaptor 15. The diverted pressurized water stream which flows into the water discharge male coupling 18 of the hose adaptor 15, next flows into the water discharge hose 20 and is discharged through the water discharge end 20*a* into the water filter 26 to maintain a suspension or slurry of the sand medium 31 and trapped particulate impurities 32 in the water filter 26 for optimum removal of the sand medium 31 and the particulate impurities 32 therefrom. The diverted pressurized water stream flowing through the aspirator conduit male coupling 17 of the hose adaptor 15 flows first through the aspirator conduit 9 and then into the main conduit 8 of the siphon fitting 7, and enters the discharge hose 4 through the discharge end 8*a* of the main conduit 8. Finally, the pressurized water exits the discharge end 4*a* of the discharge hose 4, and is discharged onto the ground, as illustrated, or into a suitable collection receptacle (not illustrated). This flowing action of the pressurized water from the aspirator conduit 9 and into the main conduit 8 of the siphon fitting 7 creates suction or reduced pressure in the main conduit 8, the suction hose 3 and the suction wand 5 by the Venturi effect. Accordingly, the suction hose 3 or the suction wand 5 (if attached to the suction hose 3, as illustrated in FIG. 1) can be placed or hand-guided in the water filter 26 such that the suction or reduced pressure therein draws or aspirates the slurry of water, sand medium 31 and suspended impurities 32 from the water filter 26, through the suction wand 5, the suction hose 3, the main conduit 8 of the siphon fitting 7, the discharge hose 4 and finally, through the discharge end 4*a* of the discharge hose 4, respectively, and onto the ground, as illustrated, or into the collection receptacle. After all or most of the particulate impurities have been removed from the water filter 26, suction pressure in the suction wand 5 is terminated by turning off the water faucet 30. The water filter 26 is typically packed with fresh sand medium 31 for continued operation thereof It will be appreciated by those skilled in the art that the hose siphon 1 facilitates a continual supply of clean water to the water filter 26 during operation in order to maintain the particulate sand medium 31 and impurities 32 in suspension in the water filter 26. The quantity of clean water discharged into the water filter 26 can be modified, as needed, by manipulation of the valve 17*a* and the valve 18*a,* respectively, of the hose adaptor 15. For example, under circumstances in which the quantity of slurry or suspension removed from the water filter 26 through the suction wand 5 or suction hose 3 exceeds the quantity of water discharged into the water filter 26 through the water discharge hose 20, the slurry or suspension has a tendency to become thick and leaves deposits of the sand and impurities on the sides and bottom of the water filter 26. Accordingly, the valve 17*a* of the hose adaptor 15 can be tightened to reduce the quantity of water flowing through the aspirator conduit 9 and divert a greater quantity of the water into the water discharge male coupling 18 of the hose adaptor 15. The valve 18*a* is also typically opened wider to accommodate the increased quantity of water diverted into the water discharge male coupling 18 and the water discharge hose 20 and into the water filter 26, to maintain the sand and particles in suspension in the water filter 26 for optimum removal therefrom.

While the preferred embodiments of the invention have been described above, it will be recognized and understood that various modifications can be made in the invention, and the appended claims are intended to cover all such modifications which may fall within the spirit and scope of the invention.

Having described my invention with the particularity set forth above, what is claimed is:

1. A hose siphon for removing particulate impurities from a vessel and discharging the impurities using pressurized water, said hose siphon comprising:

an aspirator conduit for receiving the pressurized water;

a main conduit provided in fluid communication with said aspirator conduit for receiving the pressurized water from said aspirator conduit, said main conduit having a suction end for fluid communication with the vessel and a discharge end spaced from said suction end for discharging the pressurized water from said main conduit;

whereby the impurities are aspirated from the vessel into said suction end of said main conduit and the impurities are discharged from said discharge end of said main conduit with the pressurized water, responsive to flow of the pressurized water through said aspirator conduit and into said main conduit; and a water discharge hose provided in fluid communication with said aspirator conduit for distributing a portion of the pressurized water to the vessel.

2. The hose siphon of claim 1 comprising a suction hose provided in fluid communication with said suction end of said main conduit for receiving the impurities from the vessel and distributing the impurities to said suction end of said main conduit.

3. The hose siphon of claim 1 comprising a discharge hose provided in fluid communication with said discharge end of said main conduit for discharging the impurities from said main conduit.

4. The hose siphon of claim 3 comprising a suction hose provided in fluid communication with said suction end of said main conduit for receiving the impurities from the vessel and distributing the impurities to said suction end of said main conduit.

5. A hose siphon for removing particulate impurities from a vessel and discharging the impurities using pressurized water, said hose siphon comprising:

an aspirator conduit for receiving the pressurized water;

a main conduit provided in fluid communication with said aspirator conduit for receiving the pressurized water from said aspirator conduit, said main conduit having a suction end and a discharge end spaced from said suction end for discharging the pressurized water from said main conduit;

a suction wand provided in fluid communication with said suction end of said main conduit for fluid communication with the vessel;

whereby the impurities are aspirated from the vessel, through said suction wand and into said suction end of said main conduit and the impurities are discharged from said discharge end of said main conduit with the pressurized water, responsive to flow of the pressurized water through said aspirator conduit and into said main conduit; and a water discharge hose provided in fluid communication with said aspirator conduit for distributing a portion of the pressurized water to the vessel.

6. The hose siphon of claim 5 comprising a suction hose having a first end and a second end spaced from said first end, said first end of said suction hose provided in fluid communication with said suction end of said main conduit and wherein said suction wand is provided in fluid communication with second end of said suction hose.

7. The hose siphon of claim 5 comprising a discharge hose provided in fluid communication with said discharge end of said main conduit for discharging the impurities from said main conduit.

8. The hose siphon of claim 7 comprising a suction hose having a first end and a second end spaced from said first end, said first end of said suction hose provided in fluid communication with said suction end of said main conduit and wherein said suction wand is provided in fluid communication with second end of said suction hose.

9. A hose siphon for removing particulate impurities from a vessel and discharging the impurities using pressurized water, comprising:

a hose adaptor for receiving the pressurized water;

an aspirator conduit provided in fluid communication with said hose adaptor for receiving the pressurized water from said hose adaptor;

a main conduit provided in fluid communication with said aspirator conduit for receiving the pressurized water from said aspirator conduit, said main conduit having a suction end for fluid communication with the vessel and a discharge end spaced from said suction end for discharging the pressurized water from said main conduit;

whereby the impurities are aspirated from the vessel into said suction end of said main conduit and the impurities are discharged through said discharge end of said main conduit with the pressurized water, responsive to flow of the pressurized water through said aspirator conduit and into said main conduit; and a water discharge hose provided in fluid communication with said hose adaptor for distributing a portion of the pressurized water from said hose adaptor to the vessel.

10. The hose siphon of claim 9 comprising a suction hose provided in fluid communication with said suction end of said main conduit for receiving the impurities from the vessel and distributing the impurities to said suction end of said main conduit.

11. The hose siphon of claim 9 comprising a discharge hose provided in fluid communication with said discharge end of said main conduit for discharging the impurities from said main conduit.

12. The hose siphon of claim 11 comprising a suction hose provided in fluid communication with said suction end of said main conduit for receiving the impurities from the vessel and distributing the impurities to said suction end of said main conduit.

13. The hose siphon of claim 10 comprising a suction wand provided in fluid communication with said suction hose for receiving the impurities from the vessel and distributing the impurities to said suction hose.

14. The hose siphon of claim 13 comprising a discharge hose provided in fluid communication with said discharge end of said main conduit for discharging the impurities from said main conduit.

* * * * *